US010113415B2

(12) United States Patent
Kozak et al.

(10) Patent No.: US 10,113,415 B2
(45) Date of Patent: Oct. 30, 2018

(54) METHODS AND APPARATUSES FOR DETERMINING TRUE VERTICAL DEPTH (TVD) WITHIN A WELL

(71) Applicant: Arthur H. Kozak, Edmonton (CA)

(72) Inventors: Arthur H. Kozak, Edmonton (CA); Warren Kozak, Edmonton (CA)

(73) Assignee: Arthur H. Kozak, Edmonton (CA)

( * ) Notice: Subject to any disclaimer, the term of this patent is extended or adjusted under 35 U.S.C. 154(b) by 165 days.

(21) Appl. No.: 14/965,543

(22) Filed: Dec. 10, 2015

(65) Prior Publication Data

US 2016/0168978 A1 Jun. 16, 2016

(30) Foreign Application Priority Data

Dec. 15, 2014 (CA) ..... 2874866
Apr. 8, 2015 (CA) ..... 2887268

(51) Int. Cl.
*E21B 47/04* (2012.01)
*E21B 47/06* (2012.01)

(52) U.S. Cl.
CPC ..... *E21B 47/04* (2013.01); *E21B 47/06* (2013.01); *E21B 47/065* (2013.01)

(58) Field of Classification Search
CPC ..... E21B 47/04; E21B 47/065; E21B 47/06; E21B 49/003; E21B 49/10; H01K 1/52
(Continued)

(56) References Cited

U.S. PATENT DOCUMENTS 3,038,074 A 6/1962 Scherbatskoy
3,435,629 A 4/1969 Hallenburg
(Continued)

FOREIGN PATENT DOCUMENTS

CA 2 147 610 1/2000
CA 2 721 342 A1 10/2009
CA 2 721 443 A1 10/2009
CA 2 773 632 A1 10/2013

OTHER PUBLICATIONS

"Canadian Company Set to Pave the Way Forward to Sustainability," Oil & Gas Product News: Heavy Oil & Oil Sands, © 2016 Baum Publications Ltd., <http://www.oilandegasproductnews.com/article/1089/canadian-company-set-to-pave-the-way-forward-to-sustainability>, [retrieved May 26, 2016], 10 pages.
(Continued)

*Primary Examiner* — Manish S Shah
*Assistant Examiner* — Suman K Nath
(74) *Attorney, Agent, or Firm* — Christensen O'Connor Johnson Kindness, PLLC

(57) ABSTRACT

A method of determining true vertical depth within a well penetrating a ground surface, the method including: positioning a pressure sensor at a downhole position within the well at the base of a fluid column extended from a ground surface to the pressure sensor; measuring, with the pressure sensor, a pressure exerted by the fluid column; and determining the true vertical depth (TVD) of the downhole position using the pressure measured by the pressure sensor. An apparatus for determining true vertical depth within a well, the apparatus including: a tubing string; a housing connected to the tubing string, the housing defining a chamber and having a port to the tubing string; a pressure sensor mounted to the housing and in fluid communication with the chamber.

20 Claims, 5 Drawing Sheets

(58) Field of Classification Search
USPC ..... 73/152.44, 152.51, 152.52, 152.54
See application file for complete search history.

(56) References Cited

U.S. PATENT DOCUMENTS

| | | | | |
|---|---|---|---|---|
| 3,488,970 | A | 1/1970 | Hallenburg | |
| 4,224,805 | A | 9/1980 | Rothwell | |
| 4,248,298 | A | 2/1981 | Lamers | |
| 4,375,157 | A | 3/1983 | Boesen | |
| 4,398,597 | A | 8/1983 | Haberman | |
| 4,407,136 | A | 10/1983 | de Kanter | |
| 4,559,790 | A | 12/1985 | Houston | |
| 4,878,540 | A | 11/1989 | Raymond | |
| 5,265,677 | A | 11/1993 | Schultz | |
| 5,485,089 | A | 1/1996 | Kuckes | |
| 5,829,519 | A | 11/1998 | Uthe | |
| 5,923,170 | A | 7/1999 | Kuckes | |
| 6,021,095 | A * | 2/2000 | Tubel | E21B 23/00 166/166 |
| 6,167,965 | B1 | 1/2001 | Bearden et al. | |
| 6,341,498 | B1 | 1/2002 | DiFoggio | |
| 6,497,290 | B1 | 12/2002 | Misselbrook et al. | |
| 6,769,487 | B2 | 8/2004 | Hache | |
| 7,246,940 | B2 | 7/2007 | Storm et al. | |
| 7,703,548 | B2 | 4/2010 | Clark | |
| 7,748,265 | B2 | 7/2010 | Reid et al. | |
| 7,806,173 | B2 | 10/2010 | Kaul et al. | |
| 7,962,287 | B2 | 6/2011 | Clark | |
| 8,528,636 | B2 | 9/2013 | Brooks | |
| 2004/0104052 | A1 | 6/2004 | Livingstone | |
| 2004/0112601 | A1 | 6/2004 | Hache | |
| 2005/0194184 | A1 * | 9/2005 | Gleitman | E21B 17/028 175/45 |
| 2006/0144619 | A1 | 7/2006 | Storm, Jr. et al. | |
| 2007/0277975 | A1 * | 12/2007 | Lovell | E21B 47/04 166/250.01 |
| 2008/0066534 | A1 | 3/2008 | Reid et al. | |
| 2008/0308272 | A1 * | 12/2008 | Thomeer | E21B 43/00 166/250.15 |
| 2009/0236144 | A1 | 9/2009 | Todd et al. | |
| 2010/0155058 | A1 | 6/2010 | Gordy et al. | |
| 2011/0048806 | A1 | 3/2011 | Fincher et al. | |
| 2011/0133741 | A1 | 6/2011 | Clark | |
| 2011/0146967 | A1 | 6/2011 | Winslow | |
| 2012/0125614 | A1 | 5/2012 | Verma et al. | |
| 2013/0199615 | A1 | 8/2013 | McHugh et al. | |
| 2013/0264120 | A1 * | 10/2013 | Zhou | E21B 7/046 175/61 |
| 2014/0230537 | A1 * | 8/2014 | Ringgenberg | E21B 47/06 73/152.02 |
| 2014/0367165 | A1 | 12/2014 | Marzouk et al. | |

OTHER PUBLICATIONS

"How to Calculate a Slide Sheet," at least as early as Jul. 2013, 18 pages.

* cited by examiner

METHODS AND APPARATUSES FOR DETERMINING TRUE VERTICAL DEPTH (TVD) WITHIN A WELL

CROSS-REFERENCE TO RELATED APPLICATIONS

This application claims the benefit under 35 U.S.C § 119(a) of Canada Patent No. 2,874,866, filed Dec. 15, 2014, and Canada Patent No. 2,887,268 filed Apr. 8, 2015.

TECHNICAL FIELD

This document relates to methods and apparatuses for determining true vertical depth within a well.

BACKGROUND

True vertical depth (TVD) of a vertical or horizontal well is calculated using the measured depth, inclination, and azimuth values logged at a series of survey points along the well. Example calculation methods include the tangential, average tangential, balanced tangential, mercury, radius of curvature, and minimum curvature methods. The delta (change in) TVD is calculated between each pair of survey points. The TVD of the well is the summation of all delta TVD calculations for each survey point, taking into account distance between sensor and bottom of the hole.

SUMMARY

A method of determining true vertical depth within a well penetrating a ground surface, the method comprising: positioning a pressure sensor at a downhole position within the well at the base of a fluid column extended from a ground surface to the pressure sensor; measuring, with the pressure sensor, a pressure exerted by the fluid column; and determining the true vertical depth (TVD) of the downhole position using the pressure measured by the pressure sensor.

An apparatus for determining true vertical depth within a well, the apparatus comprising: a tubing string; a housing connected to the tubing string, the housing defining a chamber and having a port to the tubing string; a pressure sensor mounted to the housing and in fluid communication with the chamber.

The disclosure defines a process in the determination of True Vertical Depth. The process may involve descending a pressure and temperature sensor below ground level with tubing, such that the tubing can be filled with a fluid of measured or calculated density and rheological properties. As the pressure and temperature sensors are being descended below ground level with tubing, pressure and temperature measurements will be recorded such that the relative density of the fluid column within the tubing can be calculated or corrected. Once the temperature and pressure sensor reach the desired depth, final pressure and temperature measurements will be taken. Using hydrostatic equations, specifically Bernoulli's Equation, the True Vertical Depth can be determined.

In various embodiments, there may be included any one or more of the following features: The fluid column comprises a liquid. The liquid comprises water. The pressure sensor is mounted to a tubing string, and positioning further comprises inserting the tubing string into the well. The tubing string comprises coiled tubing. Prior to measuring the pressure with the pressure sensor, replacing the volume of fluid in the fluid column with fresh fluid from a surface supply reservoir. The fresh fluid comprises liquid water at or near 0 degrees Celsius. A fluid circuit is defined from the surface reservoir down the fluid column and back up a return passage, for example to a surface return reservoir. Replacing further comprises circulating fresh fluid through an entire cycle of the fluid circuit. The tubing string comprises concentric tubing defining an inner passage and an outer annulus within the tubing string, in which one of the inner tubing and the outer annulus contains the fluid column, and the other one of the inner tubing and the outer annulus contains the return passage. The tubing string comprises a housing defining a chamber at the base of the fluid column, the housing having respective ports connected to the inner passage and return passage. The pressure sensor is mounted within the chamber. One of the tubing string and a well bore annulus between the well and the tubing string contains the fluid column, and the other one of the tubing string and the well bore annulus contains the return passage. The fluid column is contained within the tubing string, and the pressure sensor is mounted above a valve connected between the fluid column and the return passage. Replacing is completed within one minute. The pressure is measured by the pressure sensor while fluid in the tubing string or fluid column is stationary. The pressure is measured by the pressure sensor while fluid in the tubing string or fluid column is moving. The pressures sensor is associated with a temperature sensor at the downhole position, and further comprising measuring, with the temperature sensor, the temperature of fluid in the fluid column at the downhole position, in which determining the true vertical depth (TVD) of the downhole position further comprises using the pressure measured by the pressure sensor and the temperature measured by the temperature sensor. Repeating the stages of positioning, measuring a pressure, and measuring a temperature, at a series of downhole locations to generate a series of measurements, in which determining further comprises using the series of measurements to correct for density changes of fluid in the fluid column. Determining is carried out using a computing unit. Fluid in the fluid column comprises drilling mud, and the pressure sensor is mounted to a drill string. The pressure sensor is a first pressures sensor and further comprising measuring, with a second pressure sensor, a pressure at an uphole position of the fluid column, in which determining further comprises determining the true vertical depth (TVD) of the downhole position using the pressures measured by the first pressure sensor and the second pressure sensor. A controller is connected to the pressure sensor and having a computer readable medium for storage of pressure readings, and a TVD module for determining the TVD using pressure readings. Determining a second true vertical depth (TVD) using a position sensor within the well. A process in which a coil tubing truck with concentric coil tubing filled with a fluid used to deploy a pressure and temperature sensor into a borehole below ground level to determine TVD. Fluid would pass through the inner coil and circulate back to surface through the outer coil. A conductor cable will run through the inner coil and connect to the pressure and temperature sensor so that communications are established with surface. The density of the fluid would be corrected for pressure and temperature. A single coil tubing string is used to deploy a pressure and temperature sensor into a borehole below ground level to determine TVD. A drilling rig with drill pipe, heavy weight, or tubing is used to deploy a pressure and temperature sensor into a borehole below ground level to determine TVD. A service rig with drill pipe, heavy weight, or tubing is used to deploy a pressure and temperature sensor into a borehole below ground level to determine TVD. A valve located on the bottom of the string used to release fluid as a method of controlling the pressure and circulating the fluid. A valve located on the top of the string used to control the pressure of the fluid. The fluid is in liquid phase. The fluid is in gas phase. The fluid exhibits multiphase characteristics. A process for monitoring temperature while deploying the sensor into the borehole in which temperature readings are taken at more than one depth to correct the density of the fluid for an accurate determination of TVD. A process for circulating fluid in the string in which a valve on the bottom of the string is used to release fluid into the annulus, for the purpose of obtaining an accurate pressure for the determination of TVD. A process for controlling pressure in which a valve and pressure gauge on the top of the string are used, and which also provide an option to open to atmospheric condition, for the purpose of obtaining an accurate pressure for the determination of TVD. The fluid passes through the outer coil and is circulated back to surface through the inner coil. The coil tubing is deployed through drill pipe, heavyweight, or tubing. The pressure and temperature sensor are only recording information, and not supplying information to surface through a conductor cable. No temperature sensor is used, and therefore no temperature correction used to correctly calculate the density of the fluid. An additional secondary pressure sensor is used to measure external pressure acting on the chamber housing the primary pressure sensor. The pressure sensor is deployed into casing, where the casing acts as a barrier against formation pressures. A tractor is used to deploy the pressure and temperature sensor to be used in the determination of TVD. A wireline tractor is deployed by a wireline truck and used to pull sensors along a wellbore.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
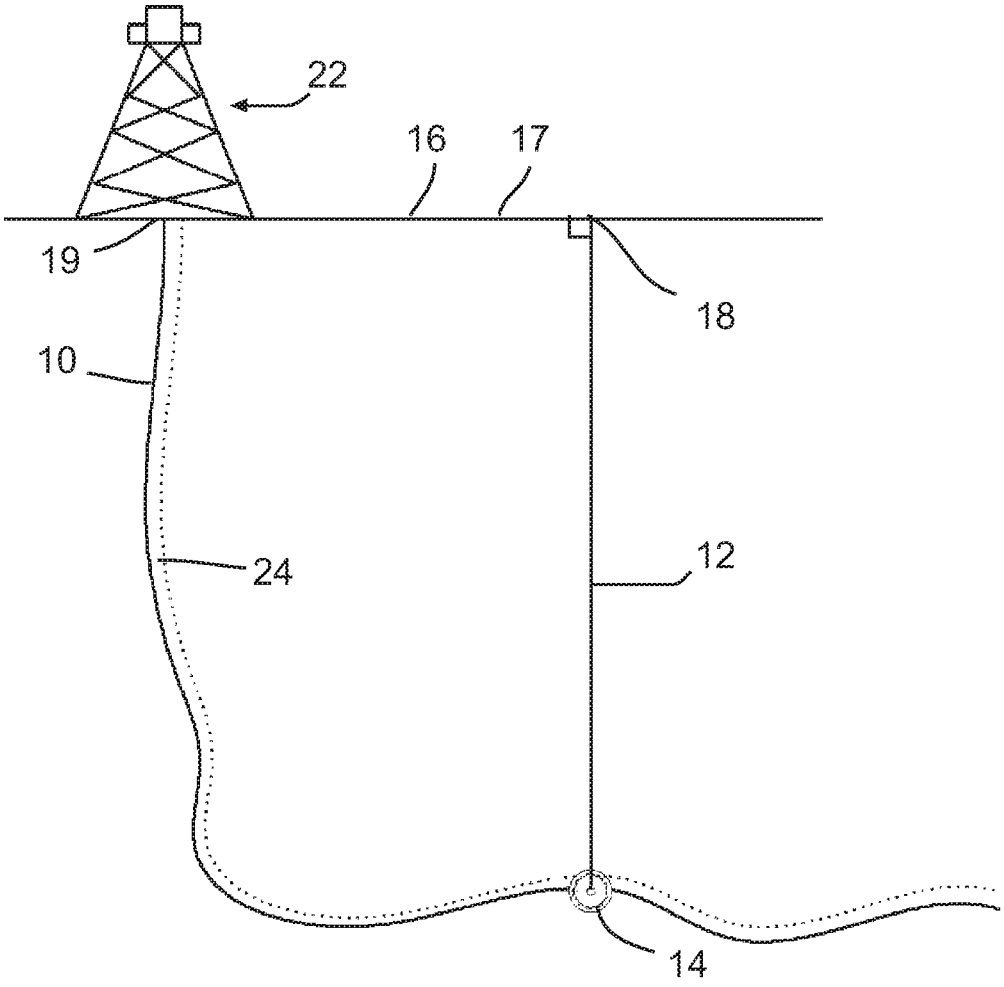
FIG. 1 is a side elevation schematic illustrating the path of a horizontal welt, from drilling rig to toe.

Referring to FIG. 1, True Vertical Depth (TVD) 12 is the distance from a point 18 along a horizontal plane 17 extending perpendicularly and vertically downward to a point 14 in a well 10 (usually the current or final depth), penetrating a ground surface 16. The point 18 is either defined as a point at level of the actual ground surface 16, or more commonly, a point in a horizontal plane 17 that intersects a reference point 19 on surface equipment, such as a drilling rig 22 at the wellhead site. In a drilling context, TVD is usually measured to a reference point 19 equal to the elevation of the rotary kelly bushing (not shown) or other position on the drilling rig 22. TVD is one of two primary depth measurements used by drillers, the other being measured depth 24 between points 14 and 19.

TVD is important in calculating bottom hole pressures, which are caused in part by the hydrostatic head of fluid in the wellbore. For such calculation, measured depth is irrelevant and TVD must be used. For most other drilling operations, the driller is interested in the length of the hole or how much pipe will fit into the hole. For such measurements, measured depth, not TVD, is used. While the drilling crew should be careful to designate which measurement they are referring to, if no designation is used, they are usually referring to measured depth. Measured depth, due to intentional or unintentional curves in the wellbore, is equal to or greater than TVD.

TVD determination is an important variable in the oil and gas industry, TVD is useful, among other things, to confirm correct well placement, well location, and reservoir dimensions, and to plan future wells, such as an adjacent production or injection well to provide a steam assisted gravity drainage (SAGD) well pair. TVD is also used for pay thicknesses, reserve estimations, and the positioning of oil/gas/water wells within a specific formation or relative to specific formations for optimum resource recovery. Inaccurate TVD determinations can be costly and dangerous when formations of high pressure or gas are encountered in error. The current method of calculating TVD is by togging with accelerometers, magnetometers, and gyros at specified depth intervals, known as survey stations. One conventional survey consists of an inclination, an azimuth, and a measured depth of which all three measurements are used to calculate TVD. All three measurements have errors associated with them. In an oil well that is 1000 m long for example, the average number of conventional survey stations will be approximately 100, with each subsequent survey station accumulating an error in addition to the previous survey station. The result is a cone of increasing error with increasing measured depth. Some of the methods and apparatuses disclosed here may only use one survey station to calculate TVD at any point below the surface, and hence uncertainties or errors may be minimized to a single survey station.

Figure 2:
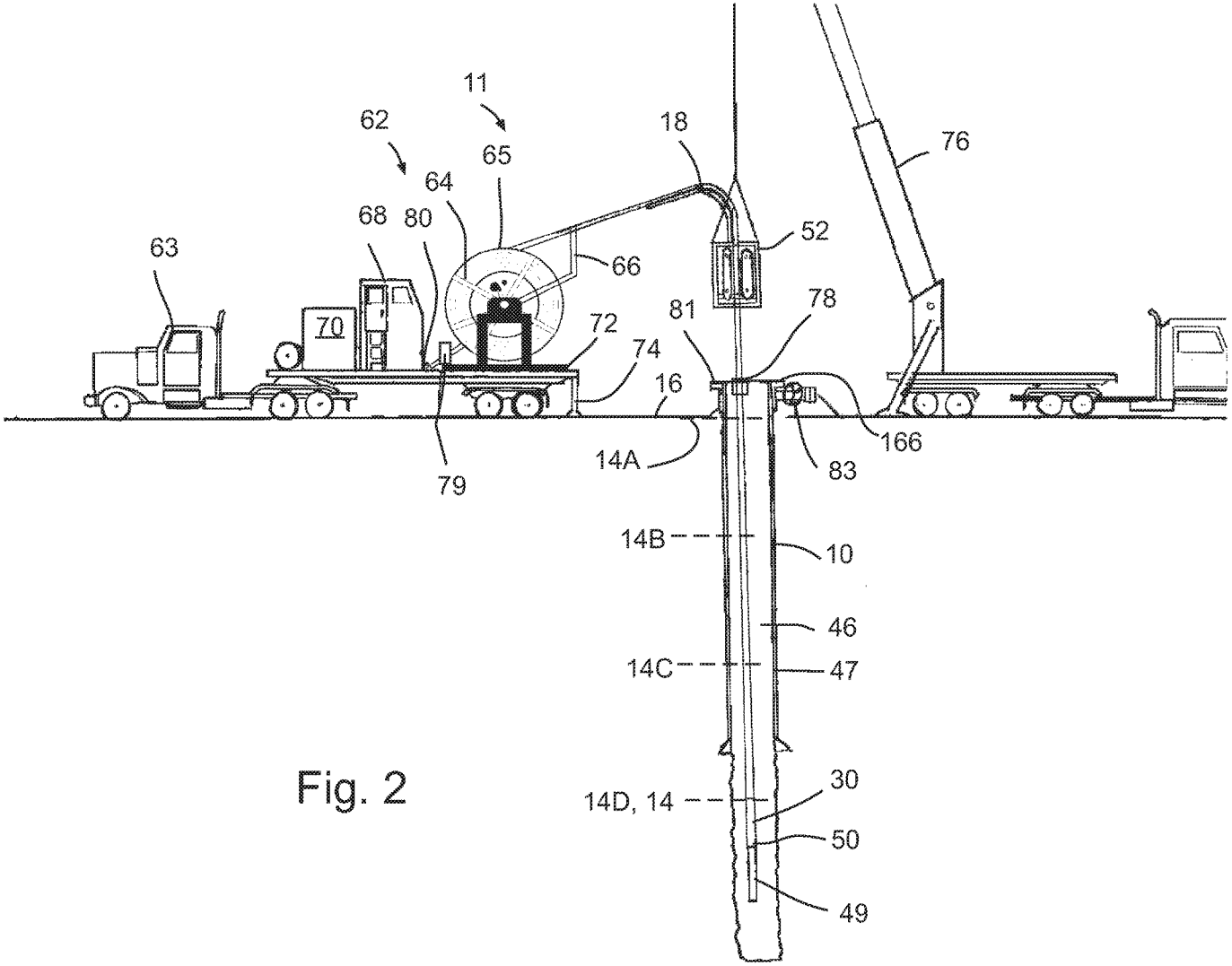
FIG. 2 is a side elevation view, partially in section, of a coiled tubing service rig injecting into a well a tubing string comprising a pressure sensor for use in the disclosed method of determining TVD.
Figure 3:
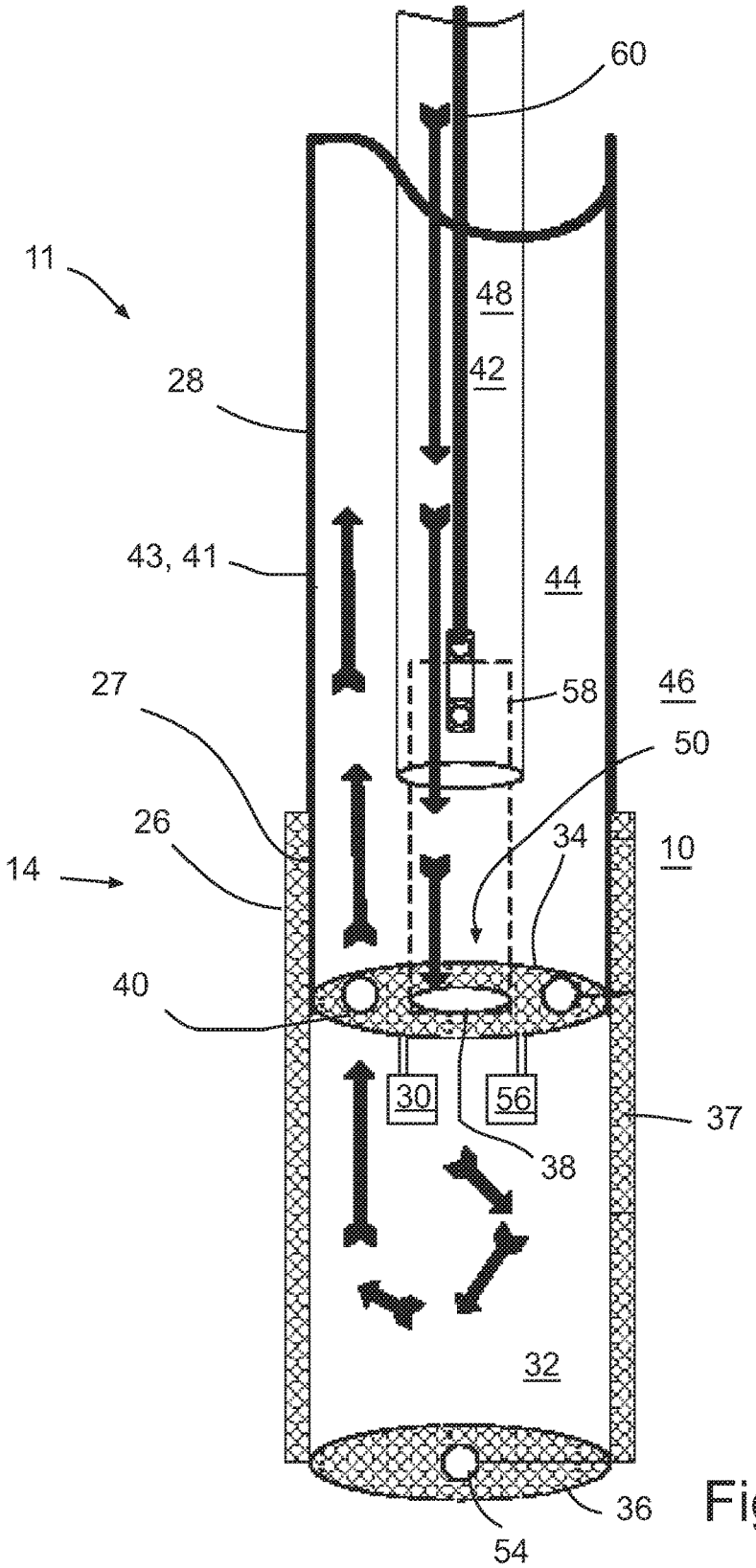
FIG. 3 is a side elevation view, in section, of a pressure sensor housing at a base of a concentric tubing string within a well.

Referring to FIGS. 2 and 3, an apparatus 11 is shown for determining TVD within a well 10 penetrating a ground surface 16. Referring to FIG. 3, apparatus 11 may comprise a housing 26, which may have a tubing connector such as a threaded connector 27 for coupling to a tubing string 28. Tubing string 28 may be coiled tubing, for example concentric coiled tubing as shown, to provide a closed loop fluid circuit that is not subject to formation influx. In use the housing 26 forms part of the tubing string 28.

A pressure sensor 30 may be mounted to the housing 26, for example within a chamber 32 defined by the housing 26. The pressure sensor 30 is located at a base 50 of a fluid column 48 (FIG. 3), the fluid column 48 extending from the ground surface 16 to a downhole position 14 at which the pressure sensor 30 is located (FIG. 3). In the example shown the fluid column 48 extends from the downhole position 14 shown to a position 18 at a maximum height in a path of tubing fed into a tubing injector 52 (FIG. 2). Further, in the example shown an inner passage 42 of the tubing string 28 contains the fluid column 48. However, the fluid column may be contained within an outer annulus 43 between the inner passage 42 and an outer coil 41 of the tubing string 28, or a well bore annulus 46 defined between the outer coil 41 and the well 10, for example the casing 47.

The housing chamber 32 may be defined by walls or plates 34, 36 spaced from one another within a sidewall such as a sleeve 37. Wall 34 may have ports, such as ports 38, 40 each for respectively connecting to a supply or return passage or line 42, 44. In the example shown, inner passage 42 is a fluid supply line, and outer annulus 43 of tubing 28 is, or contains a return passage 44. Thus, fluid enters chamber 32 via port 38 and exits via ports 40. In other cases, a second ported watt may be provided, spaced between walls 34 and 36 and that separates chamber 32 into a first and a second chamber, with a conduit extended between the second chamber and one of passages 42 and 44, and a port communicating between the first chamber. Thus, fluid flow from passage 42 to 44 would necessarily travel through the first chamber, preventing that stagnation of fluid in the first chamber containing the pressure sensor 30.

In an example where a single coil of tubing string 28 is used instead of concentric coiled tubing, no wall 34 may be needed as fluid may simply flow into the housing 26 and out to welt bore annulus 46 via a valve 54. An example of valve 54 is a float valve, which is a spring biased check valve that permits flow in for example the downhole direction only. In other cases valve 54 may be replaced by an open port. A float valve may be located on a float sub. A float valve may have a spring to keep the valve open when the pump 79, for example a hydraulic, electrical, or diesel pump, are on and fluid is travelling down the string 28, and when the flow stops or if it somehow reverses, the valve closes. The pressure sensor 30 may be mounted above the valve 54. In cases of concentric tubing a valve 54 may also be used, for example for selectively dumping fluid into the annulus 46.

Referring to FIG. 3, a temperature pressure 56 may be associated with pressure sensor 30, for example, at the same downhole position 14 as pressure sensor 30. Temperature sensor 56 may be mounted to housing 26, for example within chamber 32. Either or both sensors 30 and 56 may be carried within a cable head 58 connected by conductor wireline 60 to surface 16. The head 58 may store readings from sensors 30 and 56, or may relay the readings up to a surface controller (not shown) via wireline 60. The cable head 58 may be ported to permit passage of fluid with minimal resistance. The cable head 58 may be hollow, for example if the head 58 may also be sleeve-shaped. The inner passage 42 may extend to the wall 34 even though not shown as such in FIG. 3.

Figure 4:
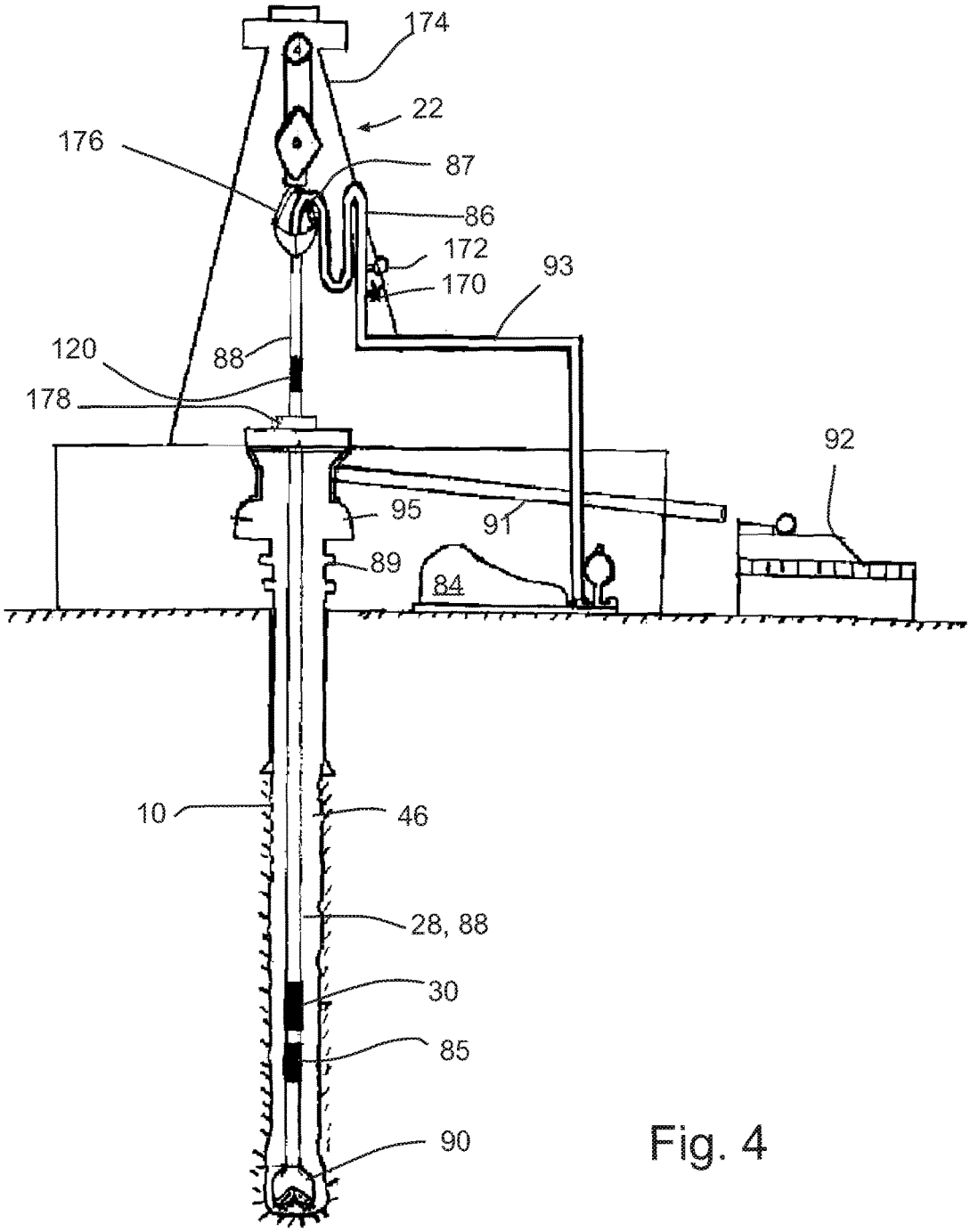
FIG. 4 is a side elevation view, partially in section, of a drilling rig drilling a well using a pressure sensor for determining TVD.

Referring to FIG. 2, a rig, such as a coiled tubing service rig 62, is illustrated for inserting the tubing string 28 into the well 10. The rig 62 may include a truck 63, a tubing reel 64 with tubing 65, a feed arm 66, a controller such as a control cabin 68, and a fluid reservoir 70. Rig 62 may be trailer 72 mounted or skid mounted. Outriggers 74 may be present to stabilize the rig 62 during injection or retraction. An injector head 52 may be located over the well 10, for example by suspension by a derrick or crane 76. Other suitable methods and machinery for injecting and removing tubing string 28 may be used, including a jointed tubing service rig, or a conventional drilling rig 22 (FIG. 4).

Referring to FIGS. 2 and 3, a method of determining TVD in a well 10 is illustrated. A pressure sensor 30 is positioned at, for example inserted to, a downhole position 14 within the well 10 at the base 50 of a fluid column 48. If a temperature sensor 56 is used, the sensor 56 is positioned at position 14 as well. The fluid column 48 may comprise liquid, for example water, for further example liquid water at or near 0 degrees Celsius. Temperatures other than 0 degrees Celsius may be used. A pressure exerted by the fluid column 48 is measured with the pressure sensor 30. Water is an environmentally safe choice of fluid because leakage of water will not damage or contaminate the formation. Water is also relatively easy to clean up in the event of a spilt. The temperature of fluid in the fluid column 48 is measured at the downhole position 14, using the temperature sensor 56 if present. The TVD of the downhole position 14 is then determined using the pressure measured by the pressure sensor 30, and using the temperature measured by the temperature sensor 56 if a temperature sensor 56 is used.

A fluid circuit may be defined from the surface reservoir 70 down the fluid column 48 and back up return passage 44, such as annulus 43, to a surface return reservoir, which may be surface reservoir 70, another reservoir such as contained on a separate skid or vehicle, or a compartment in reservoir 70, with a further compartment or compartments for fresh fluid. A radiator or other suitable cooling system may be present for cooling or heating the return fluid to within a predetermined range of suitable supply temperatures. For example, a mud chiller (not shown) may be used to cool return fluid heated by the formation. Fluid may be liquid, and may include antifreeze or other additives that modify, for example raise, the boiling temperature of a base fluid to above the maximum formation temperature. Alcohol is one example additive.

Prior to measuring the pressure with sensor 30, the volume of fluid in the fluid column 48 may be replaced with fresh fluid from a surface supply reservoir such as reservoir 70. Replacing may comprise circulating fresh fluid through an entire cycle of the fluid circuit. For example, fresh fluid may be circulated through two or three cycles to chill the string 28 and adjacent formation. Replacing may be completed within a predetermined amount of time, for example one minute, for further example five or more minutes. Circulating or replacing the fluid helps to remove from the fluid column air bubbles, which can negatively impact the density of the fluid and hence the calculation of TVD from the hydrostatic pressure of the column 48.

The pressure in column 48 may be measured while fluid in the tubing string 28 is stationary or static. Thus, after replacing, fluid flow may be stopped and pressure readings taken once the pressure stabilizes to a consistent reading. A period of time may be waited following pump shut off before pressure readings stabilize sufficient for a reading to be taken, for example to permit pressure waves within the fluid column 48 to dissipate sufficiently.

Replacing fluid followed by pressure measurement may act to reduce errors in TVD calculation caused by temperature drift, of fluid in the fluid column 48, that leads to density changes in the fluid column 48. By rapidly replacing the entire volume of fluid with fresh fluid within a range of predetermined temperatures, pressure readings may be taken prior to temperature drift substantially impacting the density of fluid along the column 48. The use of concentric tubing may be more effective at achieving such a result than in situations where spent fluid is injected out the end of the tubing string into the formation or back up the wellbore annulus 46. With concentric tubing, fluid in the outer annulus 43, as well as fluid in the wellbore annulus 46, acts to insulate the fluid in the inner fluid column 48 from the formation, thus further reducing the rate of temperature change of fluid within the fluid column 48. A formation will be warmer below a certain depth than at surface, and thus most discussions about fluid temperature in this document relate to addressing temperature increase of fluid from heat from the formation.

In some cases the density change of fluid in the fluid column 48, due to a temperature difference between fluid in the fluid column 48 and the formation, is corrected for. Such correcting may be done by developing a density or temperature profile of fluid in the fluid column 48 along the path of the well 10. Such a profile may be a moving average. By building such a profile the effect of temperature change may be corrected for, leading to more accurate calculations of TVD. For example, referring to FIG. 2, the stages of positioning, measuring a pressure, and measuring a temperature, may be repeated at a series of downhole locations or survey stations, such as locations 14A-14D. Replacement of fluid may be carried out prior to each measurement. By repeating such stages, a series of measurements is generated. The series of measurements may then be used as discussed below to correct for density changes of fluid along the fluid column 48. Density change refers to changes from the density of the fluid when such fluid was supplied to column 48 from surface reservoir 70, such as an open air surface tank. For example, the measurements may be used to calculate average density between adjacent stations, in order to calculate the delta TVD between each station, with the summation of all delta TVDs equaling the overall TVD of the well 10. Delta TVDs of sensor to bit distance or surface reference 18 to surface 16 distance may also be incorporated in the overall TVD calculation.

The pressure sensor 30 may be considered a first pressures sensor and a second pressure sensor 78 may be used to zero sensor 30 measurements. For example, second pressure sensor 78 may be positioned within column 48 to measure a pressure at an uphole position, for example the top of the fluid column 48. The TVD of the downhole position 14 may be determined using the pressures measured by the first pressure sensor and the second pressure sensor. In one example, the second pressure sensor 78 may be mounted within tubing string 28, for further example within passage 42, and maintained at surface 16 level during injection and operations, for example by controlling the length of a wireline supporting the second pressure sensor 78. In another example, the second sensor 78 is positioned at an uphole end 80 of the tubing string 28, the uphole end 80 being considered a reference point 18 a known distance from the surface 16 of the ground. In another case, a valve (not shown) may be positioned at the end 80 of tubing string 28, and before a pressure reading is taken by sensor 30, the valve is opened to equalize pressure at the top of the column 48 with atmospheric pressure, which can then be measured and subtracted from pressure measurements made by sensor 30 in calculating TVD.

Figure 3A:
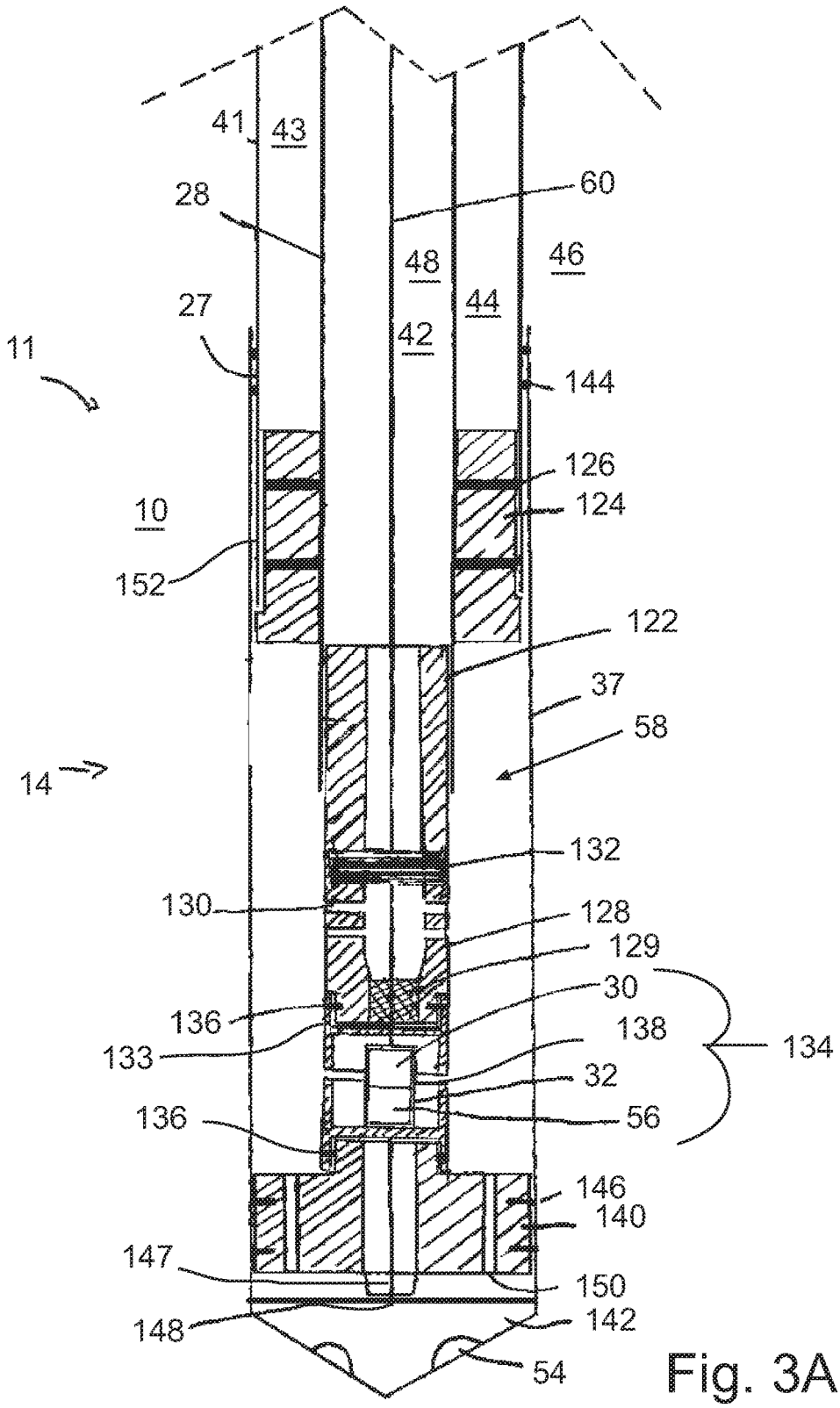
FIG. 3A is a side elevation view, in section, of a pressure sensor housing at a base of a concentric tubing string within a well.

Referring to FIG. 3A, a further embodiment of a pressure sensor housing at a base of a concentric tubing string 28 within a well 10 is illustrated. An inner coil 42 is pre-installed in an outer coil 41. A cable 60 may be pre-installed in the inner coil 28. A coil tubing roll on adapter 122 or other suitable connector may be installed onto the inner coil 42 creating a fixed unit in which the remainder of the cable head and sensor packages may be attached to. The system shown may be a closed loop or open loop circulation system. An anchor assembly 124 may be positioned between the inner coil 42 and outer coil 41 for the function of keeping the ends of the inner coil 42 and outer coil 41 fixed to one another, to avoid temperature and movement from changing the position of the ends of the two coils, of which such position changes may otherwise break the seal at the top location 27 of the sleeve 37.

A screw 126 or other suitable connector may pass from the outside of the outer coil 41, through the anchor 124, to the inner coil 28 and as to not penetrate through the inner coil 42. A pack-off assembly 128 may be threaded onto the roll-on adapter 122. Pack off assembly 128 may contain packing 129 around the cable 60 to prevent fluid flow. The pack-off assembly 128 may contain ports 130 to allow fluid to pass into the annulus 43 between the pack-off assembly 128 and the sleeve 37. The pack-off assembly 128 may comprise packing 29 for example Teflon™, grease nipples, o-rings, or other suitable components to surround the cable 60 and prevent fluid from passing by the connection 133 to the sensor housing 134. The pack-off assembly 128 may be threaded, or as the schematic shows pinned via pins 136 to sensor housing 134. The sensor housing 134 may contain chamber 32, which holds the pressure and temperature sensors 30 and 56, respectively and prevents fluid ingress or egress except through ports 138. The ports 138 may extend through the sensor housing 134 to the annulus 43 between the cablehead 58 and sleeve 37.

The sensor housing 134 may be threaded, pinned via pins 136, or connected via another suitable connector to a lower manifold 140. The lower manifold 140 allows fluid to pass through cablehead 58 to the bull nose 142. In other cases the lower manifold 140 may allow fluid to pass out of the bottom end of the sleeve 37, to attach the sleeve 37 to the sensor housing 134 and cable head 58, and to allow communication through to sensors (not shown) that may be installed below the apparatus 11. The sleeve 37 may be connected for example screwed via screws 146 onto the lower manifold 140. The sleeve 37 may be long enough to reach onto the outer coil 41. There may be seals such as o-rings 144 at a location 27 on the top of the sleeve 37 to prevent the leakage of fluid. A bullnose 142 may be screwed onto the bottom end of the sleeve 37 to keep fluid contained inside the sleeve 37.

There may be valves, such as valve 54, located on the sleeve, or float valves, or pressure activated valves, or they may be separate components located below and screwed onto the sleeve 37 instead of the bullnose 142. The cable 60 may continue through the inner coil 42, through the roll on adapter, through the pack-off assembly, into the Sensor Housing, and may be connected to the Sensor Chamber 32, or may pass through the Sensor Chamber 32 and connect directly to the pressure sensor 30. A Kemlon™ Assembly 147 may be attached to the bottom of the Sensor Chamber 134, pass through the Lower Manifold 140, and be connected to a go-pin connection 148. The go Pin Connection 148 or other connector may allow other sensors to be connected.

In use, fluid may flow down an inner coil 42 as a fluid column 48 from a point on surface 19 down through a passage in the inner coil 42. Fluid flows through a coil tubing roll on adapter 122, and passes through the pack-off assembly 128. Fluid may then pass through ports 130, entering an annulus 43 between the sleeve 37 and cablehead assembly 58. The Cable Head Assembly 58 may include roll on adapter 122, pack-off assembly 128 and any other components that are between the sensor and the inner coil.

The ports 130 on the Pack-off-Assembly 128 may be attached to the Lower Manifold 140 to circulate fluid into the hull nose 142. Such an embodiment is not illustrated in FIG. 3A. In such a case fluid may then return to surface by passage through ports 150 in bull nose 142, through channels 152 in anchor 124, and back up to surface via annulus 43.

The fluid may pass through the ports 138 in the Sensor Housing 134. The Pressure Sensor 30 and Temperature Sensor 56 will then be exposed to such fluid. In the example shown circulation of fluid is expected to have little effect on pressure readings while fluid is moving, because the sensors 30 and 56 are within a relatively static area of the apparatus 11 below but in fluid communication with the fluid circuit. The fluid in the annulus 43 between the cable head assembly 58 and the sleeve 37 may also pass through ports 150 in the Lower Manifold 140. The fluid may then circulate through other ports in the Lower Manifold, be dead ended, pass out through ports (not shown) in the bullnose 142, pass through a valve 54 into the wellbore annulus 46, pass through a pressure activated valve (not shown), pass through a float valve (not shown) or system that does not allow back flow or back pressure from the wellbore annulus 46, or simply flow out the end in which no bullnose 142 may be on the end.

Fluid in the annulus 43 between the cable head assembly 58 and the sleeve 37 may pass up through the anchor assembly 124. The Anchor Assembly 124 may be channeled, fluted, or ported, and is not shown as such on the schematic. The fluid may continue up an annulus 43 between the inner coil and the outer coil 41 to a position on surface 19. The fluid may be sealed from passage between the sleeve 37 and outer coil 41 due to a seal 27 which may consist of o-rings.

A cable 60 may run from a position on surface 19 down through a passage in the inner coil 42, through the roll on adapter 122, through a pack-off assembly 128, through chamber 32 housing the pressure sensor 30 and/or temperature sensor 56. Power and communication may be established through cable 60 which may be a multi-wire conductor cable. The apparatus 11 may be run into a well 10 penetrating the ground and positioned at a downhole location 14 to begin sampling pressure and/or temperature. The fluid may initially pass through the outer coil in the annulus 44 from a surface location 19 and return up the inner coil passage 42 to a position on surface 19.

Several example coil tubing scenarios are now discussed.

How the rig circulates fluid: Drilling Fluid or other suitable fluid such as water is pumped from a pump 79 or auxiliary pumping unit Co the coil tubing via connected pipes. The fluid passes through the coil tubing 28 down to the pressure and temperature sensors 30 and 56 which are deployed into a wellbore 10 that may or may not contain casing 47. The fluid circulates from the bottom back up a) through well bore annulus 46, which is the void between the coil tubing 28 and the formation, and out via a suitable manifold or valve 83 (for example on a casing bowl 166), or to reservoir 70, which may be several reservoirs, or b) between coil tubing 28 and a casing string 47 to surface 16. At surface 16 the fluid may travel through a blow out preventer (BOP, not shown), a wellhead 81, or fill up in a cellar (not shown). The fluid is either pumped out of the cellar, or it is passed through a flow line to tanks, such as reservoir 70, which may be ground or truck mounted.

Scenario 1—the Single Coil Tubing String: Pressure sensor 30 measures the internal pressure of fluid column 48. Sensor 30 or an additional pressure sensor external to the tubing string 28 may measure pressure in the well bore annulus 46. Once the pressure and temperature sensors 30, 56 have been deployed into the wellbore 10 the coil tubing rig or truck 63 pumps a complete circulation of fluid. Once the pump are turned off, a valve (not shown) on the coil tubing rig 62 may be open such that the fluid at surface is open to atmosphere. The top of this fluid may be the zero mark, or position 18 for TVD and can be referenced to any point on the coil tubing rig 62 or on surface 16. The pressure measured by the downhole pressure sensor 30 of the static fluid inside the coil tubing 28 is the a hydrostatic pressure, from which TVD can be calculated. To be able to circulate fluid properly, the bottom end of the coil tubing 28 and pressure sensor 30 may be open ended or ported. A wireline 60 may be run through the coil tubing 28 to provide power and communications to the downhole sensors, or if a wireline is not run then the downhole sensors may be battery powered and only provide recorded only information.

Scenario 2—the Concentric Coil Tubing String: The same as scenario 1 except a concentric coil tubing string is used. A concentric coil tubing string contains an inner coil tubing string, which is shown in FIG. 3 as inner passage 42. Circulation of fluid can pass both through the inner coil tubing and back out through the outer coil tubing 41, or it can be in reverse.

Scenario 3—the Float: The same as scenario 1 except a float (a device that prevents fluid from coming back up the coil tubing string and cause back pressure) is used and positioned anywhere in the coil tubing 28 below the pressure sensor 30. The float valve, for example, valve 49 in FIG. 2, may prevent flow back up the coil tubing 28, such flow back potentially causing unstable pressure readings. Such back flow may be caused by influxes of formation, or u-tubing, or surging the tubing.

Scenario 4—the Valve: The same as scenario 3 except the float valve is any valve 54 that is opened with a certain pressure, or under surface control, and allows fluid to circulate out of the coil tubing 28.

Scenario 5—Second Upper Pressure Sensor on Surface: A second upper pressure sensor 78 may be used at surface 16 anywhere in the plumbing. The difference in measured pressures between the upper pressure sub and the lower pressure sub is hydrostatic pressure, from which TVD may be calculated.

Scenario 6—A Secondary Downhole Pressure Sensor: A secondary downhole pressure sensor (not shown) may be used to measure the external pressure acting on the housing 26 in which the downhole pressure sensor 30 is housed. Thus, the secondary sensor may be mounted to the outside of the housing 26, and may be used to measure the pressure of the fluids in the outer wellbore annulus 46. If the fluid in the outer wellbore annulus 46 extends to surface 16, it may be possible to calculate TVD from the fluid column in the annulus 46, assuming that the fluid has a measurable density and consistency of composition.

Referring to FIG. 4, a drilling rig 22 is illustrated. Fluid in the fluid column 48 may comprise drilling mud in such an example, and the pressure sensor 30 may be mounted to a drill string 88 as tubing string 2N. The pressure sensor 30 may be mounted above or below other well logging sensors, such as a position sensor 85 used to calculate the orientation of the well 10. The method may further comprise determining a second true vertical depth (TVD) using the position sensor 85 within the well 10, for example using conventional TVD calculation methods. The second TVD may be compared to or used in conjunction with the TVD determined using the sensor 30 readings. A position sensor may be one or more of an accelerometer, magnetometer, gyro, measuring while drilling (MWD), and ranging tool. Comparing the TVDs provides a measure of security in case of sensor or calculation error in either method. Comparing the TVDs also provides a method of verifying the TVD determined using sensor 30. A drill bit 90 may terminate the drill string 88.

Several example drilling rig scenarios are now discussed.

How the rig 22 circulates fluid: Drilling Fluid may be pumped from a mud pump 84 to the rig 22 via connected pipes 93. Mud passes a valve 170 and pressure transducer 172 and through a standpipe 86, through a rotary hose 87, and down drill pipe 88. Drill pipe 88 may be suspended by a derrick 174 and swivel 176, and passes through a kelly bushing or rotary table 178. At the bottom of the drill pipe may be a bit 90, or drill string 88 may be open ended or contain a bottom hole assembly (not shown). The fluid circulates from the bottom back up through a well bore annulus 46 to surface. At surface the fluid may travel through reference numerals 89, 95, which may each be a BOP, rotating BOP, or a diverter. Fluid then passes exits the well via a flow line 91, and may fill up in a cellar (not shown) The fluid is either pumped out of the cellar, or it is passed through a flow line to shakers, transfer tanks, and shale bins, collectively 92. The exiting fluid is naturally at atmospheric pressure.

Scenario 1 on the Drilling Rig: The temperature sensor 56 may exist in a separate sub, or be in the same sub as the pressure sensor 30. Once the pressure and temperature sensor 30, 56 have been deployed into the wellbore 10 which may or may not contain casing, the rig 22 may pump one complete circulation of fluid. Once the pumps are turned off, the upper sub connection 120 may be broken and open to atmosphere. The top level of the fluid inside of the drill pipe would be visible, and it would be measured to a fixed point on the rig. It is industry standard to reference depth to the rig's drill floor or Kelly bushing. The pressure measured by the lower pressure sub 30 of the static (static because the rig is not pumping and the fluid is not moving) fluid inside the drill string/heavy weight 88 will be a hydrostatic pressure, from which TVD can be calculated.

Scenario 2 on the Drilling Rig: The same as scenario 1 except a float sub (a sub that prevents fluid from coming back up the drill string and cause back pressure) is used and positioned anywhere in the drill string 88 below the lower pressure sub 30.

Scenario 3 on the Drilling Rig: A second sub, upper pressure sub (not shown), is used. In this scenario, the connection does not need to be broken at surface. The difference in measured pressures between the upper pressure sub and the lower pressure sub 30 is hydrostatic pressure, from which TVD can be calculated. A float sub may also be used in this scenario. The upper pressure sub may only be used to measure internal pressure, and may also measure temperature (an upper temperature sensor may exist in a separate sub, or be in the same sub as the pressure sensor).

Scenario 4 on the Drilling Rig: The lower pressure sub 30 may be used, and there is no broken connection at surface so that the system still remains closed during measurement. A pressure sensor, such as a transducer not shown) may be positioned in the flow-in line or on the standpipe 86. A valve (not shown) may be located between the transducer and the pump 84. A complete circulation may be performed and then the pump 84 may be turned off. The valve may be closed to isolate the system from the pump and pulsation dampener(s), which can create oscillations or pressure pulses. The difference in pressure between the transducer and lower pressure sub 30 is hydrostatic pressure from which TVD can be calculated.

Scenario 5 on the Drilling Rig: The same as scenario 1 except a valve is located on the bottom of the string that opens based on a specific designed pressure to allow circulation of fluid. For example, when the pumps are operating, the valve may remain open allowing fluid to pass out of the bottom of the string, and when the pumps shut off the valve would close. This would avoid annular influences of pressure as opposed to using an open ended bottom.

Scenario 6 on the Drilling Rig: The lower pressure sensor contains a secondary pressure sensor used to measure the annular pressure that is acting on the housing of the lower pressure sensor.

TVD Determination

TVD may be determined using downhole pressure measurements in a suitable fashion. For example, the Bernoulli equation and principle may be used. Using fluid, such as water or other liquids, that is assumed to be incompressible, the basic formula is that, for any position in the fluid column:

$$\frac{v^2}{2} + gz + \frac{p}{\rho} = \text{constant} \quad 1)$$

The calculation can be written as follows when comparing two points in a fluid column:

$$P_1 + \tfrac{1}{2}\rho v_1^2 + \rho g h_1 = P_2 + \tfrac{1}{2}\rho v_2^2 + \rho g h_2 \quad 2)$$

where P=pressure in Pascal at two locations in the fluid column, ρ=average density in kg/m$^3$ average along the fluid column, g=acceleration due to gravity, v=velocity of the fluid in m/s, and h=fluid column height at the point measured.

In a static (no fluid flowing, pumps are off) environment, kinetic energy will be zero, and the height (TVD) of a fluid column 48 can be calculated using the following formula:

$$z = \frac{P_2 - P_1}{\rho_{avg} * g} \quad 3)$$

where z=fluid column height in meters, $P_1$ and $P_2$=pressure in Pascal's at two locations in the fluid column, $\rho_{avg}$=density in kg/m$^3$ average along the fluid column, and g=acceleration due to gravity.

In the summation of survey intervals example of FIG. 2, the summation represented by:

$$z = \sum_{i=1}^{n} \frac{2}{g} * \frac{P_{i+1} - P_i}{\rho_{i+1} + \rho_i} \quad 4)$$

where n is the number of surveys taken, $P_i$=pressure in Pascal's at a survey location i in the fluid column, ρ=density in kg/m$^3$ at a survey location i in the fluid column, and g=acceleration due to gravity.

Calculating a weighted average of column of fluid may also be done using measured depth, using the formula below. In this example the fluid column 48 is broken up into survey intervals each with a measured depth and density calculation or measurement.

$$\rho_{avg} = \frac{\sum_{i=1}^{n} (MD_i - MD_{i-1})\rho_i}{\sum_{i=1}^{n} (MD_i - MD_{i-1})} \quad 5)$$

where MD is the measured depth in meters at a survey station, n is the number of stations, and ρ is the density in $kg/m^3$.

The density may be corrected for errors, for example caused by pressure, salinity, or temperature errors. Because water is assumed to be incompressible, and is substantially incompressible even at relatively high wellbore pressures, in some cases pressure may not be corrected for.

The density of water is a function of the temperature of the water. For example, water density changes may be calculated using the following formula as a function of temperature only:

$$\rho = \rho_0 * \left(1 - \frac{T + 288.9414}{508929.2 * (T + 68.12963)} * (T - 3.9863)^2\right) \quad 6)$$

where T is temperature in Celsius, and ρ and ρ0 are corrected, and initial at zero degrees, respectively, density in $kg/m^3$.

Density changes as a function of temperature and salinity, for example according to:

$$\rho_0=\rho_w+6.793952E-2*T-9.095290E-3*T^2+1.001685E-4*T^3-1.120083E-6*T^4+6.536332E-9*T^5 \quad 7)$$

where T is temperature (° C.), $\rho_w$ is the density ($kg/m^3$) of pure water equal to 999.842594 $kg/m^3$ at 1 atm, and $\rho_0$ is corrected density ($kg/m^3$).

Density changes as a function of temperature and salinity, for example according to:

$$\rho_1=\rho_0+AS+BS^{(3/2)}+CS^2$$

$$A=8.24501E-1-4.0639E-3*T+7.571.9E-5*T^2-8.8910E-7*T^3+6.616E-9*T^4$$

$$B=-5.7728E-3+9.7437E-5*T-1.3747E-6*T^2$$

$$C=4.9054E-4 \quad 8)$$

where $\rho_1$ is the corrected density ($kg/m^3$), and $\rho_0$ is the corrected density ($kg/m^3$) for temperature, T is Temperature (° C.), and S is Salinity (ppt).

Density change due to pressure, temperature, and salinity can be roughly expressed as $$\rho_2=\rho_1/(1-P/k_2) \quad 9)$$

where $\rho_2$ is the final corrected density for pressure, temperature, and salinity ($kg/m^3$), $\rho_1$ is the density corrected for temperature and salinity ($kg/m^3$), $k_2$ is the Secant Bulk Modulus as a function of pressure, temperature, and salinity, and P is the applied pressure (bars).

$$k_2=k_1+AP+BP^2 \quad 9)$$

where k1 is the Secant Bulk Modulus as a function of temperature and salinity, P is the applied pressure (bars), and A and B are coefficients.

$$k_1=k_w+(57.6746-0.603459*T+1.09987E-2*T^2-6.1670E-5*T^3)*S+(7.944E-2+1.6483E-2*T-5.3009E-4*T^2)*S^{(3/2)}$$

$$A=A_w+(2.2838E-3-1.0981E-5*T-1.6078E-6*T^2)*S+1.91075E-4*S^{(3/2)}$$

$$B=B_w+(-9.9348E-7+2.0816E-8*T+9.1697E-10*T^2)*S$$

$$k_w=19652.21+148.4206*T-2.327105*T^2+1.360477E-2*T^3-5.155288E-5*T^4$$

$$A_w=3.239908+1.43713E-3*T+1.16092E-4*T^2-5.77905E-7*T^3$$

$$B_w=8.50935E-5-6.12293E-6*T+5.2787E-8*T^2 \quad 10)$$

Where $k_1$ is Secant Bulk Modulus as a function of temperature and salinity, T is Temperature (° C.), S is Salinity (ppt), $k_w$ is the Secant Bulk Modulus as a function of temperature, and Aw and Bw are coefficients.

Many of the variables in the equation 5 above and other equations in this document may be subject to change under different conditions, and the changes may be taken into account in determining TVD.

When pressure is changed the water density can be corrected using:

$$\rho_1 = \rho_0 * \frac{1}{\left(1 - \frac{\rho_1 - \rho_0}{E}\right)} \quad 10)$$

where $\rho_1$=final density ($kg/m^3$), $\rho_0$=initial density ($kg/m^3$), E=bulk modulus fluid elasticity (N/m2), and $P_1$ and $P_2$=pressure in Pascal's at two locations in the fluid column.

The density of a fluid when changing both temperature and pressure can be expressed roughly by:

$$\rho_1 = \frac{\rho_0}{1 + \beta(t_1 - t_0)} * \frac{1}{\left(1 - \frac{\rho_1 - \rho_0}{E}\right)} \quad 11)$$

where $\rho_1$ final density ($kg/m^3$), $\rho_0$ initial density ($kg/m^3$), β=volumetric temperature expansion coefficient ($m^3/m^3$ ° C.), $t_1$=final temperature (° C.), $t_0$=initial temperature (° C.), E=bulk modulus fluid elasticity (N/m2). The bulk modulus of water is 2.15 $10^9$ ($N/m^2$).

Depth (Z) can be expressed as a function of Pressure, P, and the latitude of the place, θ. The expression is given by:

$$Z(P,\theta)=9.72659\times10^2P-2.2512\times10^{-1}P^2+2.279\times10^{-4}P^3-1.82\times10^{-7}P^4+1.092\times10^{-4}P+g(\theta) \quad 12)$$

where g(θ), the international formula for gravity, is given by:

$$g(\theta)=9.780318(1+5.2788\times10^{-3}\sin^2\theta+2.36\times10^{-5}\sin^4\theta) \quad 13)$$

where depth in meters, pressure in MPa (relative to atmospheric pressure).

The Pressure (P) can be expressed as a function of depth, Z, and the latitude of the place, θ. The expression is given by:

$$P(Z, \theta) = h(Z, \theta) \quad 14)$$

$$h(Z, \theta) = h(Z, 45) \times k(Z, \theta) \quad 15)$$

$$h(Z, 45) = 1.00818 \times 10^{-2}Z + 2.465 \times 10^{-8}Z^2 - 1.25 \times 10^{-13}Z^3 + 2.8 \times 10^{-19}Z^4 \quad 16)$$

$$k(Z, \theta) = \frac{g(\theta) - 2 \times 10^{-5}Z}{9.80612 - 2 \times 10^{-5}Z} \quad 17)$$

$$g(\theta) = 9.780318(1 + 5.2788 \times 10^{-3}\sin^2\theta + 2.36 \times 10^{-5}\sin^4\theta) \quad 18)$$

where depth is in metres and pressure in MPa (relative to atmospheric pressure).

Calculations may take into account temperature drift between measured fluid temp at sensor 30 at a downhole position such as 14C, and actual temperature at the same downhole location 14C when the sensor 30 is moved to a different position, such as 14D. A moving or weighted average of fluid density may be used for summation calculations.

In one example, a secondary temperature and pressure sensor or set of temperature and pressure sensors (not shown) may be used with or instead of sensors 30 and 56. For example, in one case a series of pairs of temperature and pressure sensors are spaced along a wireline extended from surface 16 down to the base of the fluid column 48. The tubing string 28 may be injected into the formation, and position at a downhole position 14 where a TVD is desired, for example at the toe of the well. Fluid may be circulated through the fluid circuit until stable temperature readings are achieved in the series of temperature sensors. The fluid circulation, if any, may then be stopped and temperature and pressure readings taken. The pairs of sensors may be spaced at regular survey intervals, such as every 10 meters of measured depth. The readings along the wireline above the base of the fluid column 48 may be used to generate a density profile, which is then used to calculate TVD using the pressure at the base of the column 48.

In another example, the pair of sensors 30 and 56, or a secondary pair of pressure and temperature sensors are connected via wireline at the base of the fluid column 48. The sensor pair may be removably connected, for example initially magnetically connected to the tubing string 28 at the base, or connected via a lock that can be unlocked with a tension above a predetermined tension. The tubing string 28 is injected into the well 10, and positioned at a desired downhole location 14 where a TVD reading is desired. Fluid may be circulated until a stable temperature is reached, and a pair of pressure and temperature readings is taken, for example after fluid circulation is stopped. A consistent period of time, for example, 20 seconds may be waited after stopping circulation in order to permit stabilization of pressure and temperature readings. Next, fluid circulation may begin again, and the sensor pair is raised a predetermined survey interval, for example, ten meters measured depth. The cycle of repositioning, circulating, waiting (optional), and measuring may be repeated all the way up the fluid column 48, to generate a density profile and calculate TVD. In some cases the wait time is based on the time needed to reach a predetermined temperature or range of temperatures at the base of the fluid column 48, or at the surface return of fluid exiting the fluid circuit at surface. The pair of sensors may be positioned on a sleeve and may be weighted so as to impart minimal fluid resistance when moving in the fluid column 48 and to apply tension to the wireline while suspended in fluid.

In another case, the fluid column 48 may be an inner coil of a coil in coil in coil tubing string 28. An actual coil in coil in coil string 28 (three coils) may be used, or the inner passage 42 may be used as a fluid column 48, the outer annulus 44 is the supply or return passage, and the outer wellbore annulus is the other of the supply or return passage. During use, fluid in the fluid column 48 in the inner passage 42 may remain static, although some flushing may be carried out to remove air bubbles. Fluid circulating may be carried on through the fluid circuit external to the fluid column 48 at a pumping rate selected to maintain a consistent temperature profile throughout the fluid column 48, for example, with a feedback loop designed to slow down the pump when the base temperature drops below a predetermined range, and increase the pump when the base temperature rises above the predetermined range. Because the fluid column 48 is static throughout the circulation, a pair of sensors may be raised or lowered across the entire height of the fluid column 48 without experiencing pressure waves, and in order to take a series of measurements along the entire height of the fluid column 48. A density profile may then be calculated and TVD from the desired downhole point 14 determined.

In another case, an initial stage may comprise positioning the tubing string 28 at the downhole position 14 in the well 10, and circulating fresh fluid until the adjacent formation cools sufficiently enough to provide a stable temperature along the height of the fluid column 48 even when circulation is turned off.

Referring to FIG. 2, determining may be carried out using a computing unit, such as contained within control cabin 68. The controller may be connected to the pressure sensor 30 and sensor 56, and other sensors in the system, and may have a computer readable medium for storage of readings, and a TVD module for determining the TVD. In other cases, the computing unit may comprise a computer, running a program such as Excel™ or a suitable spreadsheet program, with a data entry sheet, and a macro or other algorithm designed to determine TVD from data entries into the program. Various inputs may be used with the algorithm. For example, Table 1 below shows some example reference inputs that may be used for determining TVD,

TABLE 1

| Reference Point | | |
|---|---|---|
| Reference Depth = | 0 | m asl |
| Sensor Pressure = | −5.94 | kPa |
| Fluid Density = | 1002 | kg/m3 |
| Temperature = | 10 | ° C. |
| Salinity = | 0 | g/kg |
| Bulk Modulus of Fluid Elasticity | 2150000000 | N/m2 |

Table 2 below shows a sample data entry sheet for use in calculating TVD. Data may be entered at each survey point under the depth, pressure, and temperature columns, and an algorithm run to calculate TVD. Regarding TVD subscripts, the raw column provides an uncorrected calculated, the T&S a correction based on temperature and salinity, and the T&S&P a correction based on temperature, salinity and pressure,

TABLE 2

| Date (dd-mmm-yyyy) | Time (hh:mm:ss) | Depth (m) | Pressure (kPa) | Temperature (° C.) | $TVD_{raw}$ (m) | $TVD_{T\&S}$ (m) | $TVD_{T\&S\&P}$ (m) |
|---|---|---|---|---|---|---|---|
| 1 | | 4.49 | 38.63 | 14.5 | 4.53 | 4.54 | 4.54 |
| 2 | | 4.99 | 43.587 | 14.5 | 5.04 | 5.05 | 5.05 |
| 3 | | 5.49 | 48.412 | 14.6 | 5.53 | 5.54 | 5.54 |
| 4 | | 5.99 | 53.013 | 14.6 | 6.00 | 6.01 | 6.01 |

Tables 3A-B below illustrate several sample corrections of density used in building a dens Mile of fluid in the fluid column.

TABLE 3A

| | Measured Depth (m) | Pressure (kPa) | Temperature (° C.) | Density Corrected for Temperature and Salinity ($kg/m^3$) | Density Corrected for Temp, Salinity, and Pressure ($kg/m^3$) |
|---|---|---|---|---|---|
| 0 | 0 | 0 | 10 | 1002.00 | 1002 |
| 1 | 4.49 | 44.57 | 14.5 | 999.1755 | 999.1963383 |
| 2 | 4.99 | 49.527 | 14.5 | 999.1755 | 999.1986575 |
| 3 | 5.49 | 54.352 | 14.6 | 999.16 | 999.1863588 |
| 4 | 5.99 | 58.953 | 14.6 | 999.16 | 999.1885105 |

TABLE 3B

| TVD No Corrections (m) | TVD Temp and Salinity Corrected (m) | TVD Temp, Salinity, and Pressure Corrected (m) |
|---|---|---|
| 0 | 0 | 0 |
| 4.53425463 | 4.540654405 | 4.540607089 |
| 5.03854676 | 5.04637209 | 5.046313633 |

TABLE 3B-continued

| TVD No Corrections (m) | TVD Temp and Salinity Corrected (m) | TVD Temp, Salinity, and Pressure Corrected (m) |
|---|---|---|
| 5.529410089 | 5.538626597 | 5.538556171 |
| 5.997485152 | 6.00803167 | 6.007948796 |

Below is sample macro code for an algorithm to be used to calculate TVD upon activating a function CalButton_click. The macro is written in Visual Basic for Applications (VBA). In the example shown, Table 1 (spreadsheet rows N20:P26) and Table 2 (spreadsheet rows G28:P26) occupy a first sheet of a spreadsheet called "Data Sheet", and Tables 3A-3B (spreadsheet rows A1:F7, G1:I7, respectively) occupies a second sheet of the spreadsheet, called "Density Corrections".

The algorithm corrects the density for temperature, salinity, and pressure at each survey station. Then for each interval between stations, and average of the corrected density is assumed. The change in True Vertical Depth is then calculated between each survey interval. The summation of the changes in True Vertical Depth between each survey interval will provide a total True Vertical Depth. For such a reason, the more frequent and close together the survey's, the lower the error induced in averaging of corrected densities.

```
Private Sub CalButton_Click( )
Dim i As Integer
Dim DensityZero, TempInitial, PressureInitial, Sal, E As String
Dim PW(0 To 1000)
Dim TW(0 To 1000) As String
Dim MD(0 To 1000) As String
Dim ColumnRaw(1 To 1000) As String
Dim ColumnTS(1 To 1000) As String
Dim ColumnTSP(1 To 1000) As String
Dim TotalColumnR(1 To 1000) As String
Dim TotalColumnTS(1 To 1000) As String
Dim TotalColumnTSP(1 To 1000) As String
Dim CR, CTS, CTSP As String
Dim RD
Sheet2.Range("G4:K1003").ClearContents
CR = 0
CTS = 0
CTSP = 0
RD = Sheet1.Range("o21").Value
PressureInitial = Sheet1.Range("O22").Value
DensityZero = Sheet1.Range("Q23").Value
TempInitial = Sheet1.Range("O24").Value
Sal = Sheet1.Range("O25").Value
E = Sheet1.Range("O26").Value
For i = 0 To 1000
    PW(i) = Sheet2.Range("C" & i + 3).Value
    TW(i) = Sheet2.Range("D" & i + 3).Value
    MD(i) = Sheet2.Range("B" & i + 3).Value
Next i
'Density Calculations
For i = 1 To 1000
    'Density corrected for Temperature and Salinity
    If Sheet2.Range("D" & i + 3).Value <> "" And Sheet1.Range("o25").Value <>
"" And Sheet1.Range("q23").Value <> "" Then
        Sheet2.Range("E" & i + 3).Value = DensityTempSal(DensityZero, TW(i),
Sal)
        Else
        Sheet2.Range("E" & i + 3).Value = ""
    End If
    'Density corrected for Temperature, Salinity, and Pressure
    If Sheet2.Range("E" & i + 3).Value <> "" Then
        Sheet2.Range("F" & i + 3).Value = Sheet2.Range("E" & i + 3).Value / (1 -
PW(i) * 0.01 / Kstp(PW(i), TW(i), Sal))
        Else
        Sheet2.Range("F" & i + 3).Value = ""
    End If
Next i
```

-continued

```
'Raw TVD Calculations
For i = 1 To 1000
    If Sheet2.Range("C" & i + 3).Value <> "" Then
    ColumnRaw(i) = (PW(i) - PW(i - 1)) * 1000 / 9.81 /
Sheet1.Range("o23").Value
    TotalColumnR(i) = ColumnRaw(i) + CR * 1
    CR = TotalColumnR(i)
        If Sheet1.Range("P21").Value = "m" Or Sheet1.Range("P21").Value = "m
TVD" Or Sheet1.Range("P21").Value = "m MD" Or Sheet1.Range("P21").Value = "m KB"
Then
            Sheet2.Range("G" & i + 3).Value = CR * 1 + RD * 1
        End If
        If Sheet1.Range("P21").Value = "m asl" Then
            Sheet2.Range("G" & i + 3).Value = RD * 1 - CR * 1
        End If
        If Sheet1.Range("P21").Value = "m ss" Then
            Sheet2.Range("G" & i + 3).Value = CR * 1 - RD * 1
        End If
    Else
    i = 1000
    End If
Next i
'TVD Calculations Corrected for Temperature and Salinity
For i = 1 To 1000
    If Sheet2.Range("C" & i + 3).Value <> "" Then
    ColumnTS(i) = 2 * (PW(i) - PW(i - 1)) * 1000 / 9.81 / (Sheet2.Range("E" & i +
2).Value + Sheet2.Range("E" & i + 3).Value)
    TotalColumnTS(i) = ColumnTS(i) + CTS * 1
    CTS = TotalColumnTS(i)
        If Sheet1.Range("P21").Value = "m" Or Sheet1.Range("P21").Value = "m
TVD" Or Sheet1.Range("P21").Value = "m MD" Or Sheet1.Range("P21").Value = "m KB"
Then
            Sheet2.Range("H" & i + 3).Value = CTS * 1 + RD * 1
        End If
        If Sheet1.Range("P21").Value = "m asl" Then
            Sheet2.Range("H" & i + 3).Value = RD * 1 - CTS * 1
        End If
        If Sheet1.Range("P21").Value = "m ss" Then
            Sheet2.Range("H" & i + 3).Value = CTS * 1 - RD * 1
        End If
    Else
    i = 1000
    End If
Next i
'TVD Calculations Corrected for Temperature and Salinity and Pressure
For i = 1 To 1000
    If Sheet2.Range("C" & i + 3).Value <> "" Then
    ColumnTSP(i) = 2 * (PW(i) - PW(i - 1)) * 1000 / 9.81 / (Sheet2.Range("F" & i
+ 2).Value + Sheet2.Range("F" & i + 3).Value)
    TotalColumnTSP(i) = ColumnTSP(i) + CTSP * 1
    CTSP = TotalColumnTSP(i)
        If Sheet1.Range("P21").Value = "m" Or Sheet1.Range("P21").Value = "m
TVD" Or Sheet1.Range("P21").Value = "m MD" Or Sheet1.Range("P21").Value = "m KB"
Then
            Sheet2.Range("I" & i + 3).Value = CTSP * 1 + RD * 1
        End If
        If Sheet1.Range("P21").Value = "m asl" Then
            Sheet2.Range("I" & i + 3).Value = RD * 1 - CTSP * 1
        End If
        If Sheet1.Range("P21").Value = "m ss" Then
            Sheet2.Range("I" & i + 3).Value = CTS * 1 - RD * 1
        End If
    Else
    i = 1000
    End If
Next i
End Sub
Private Function DensityTempSal(DensityZero, Temp, Salinity) As Double
'This will calculate AS + BS^3/2 + CS^2 where the coefficients A,B, and C are
taken from Poisson et al, 1980
Dim A, B, C
Dim DensityTemp As String
DensityTemp = DensityZero + 6.793952 * 10 ^ (-2) * Temp - 9.09529 * 10 ^ (-3)
* Temp ^ 2 + 1.001685 * 10 ^ (-4) * Temp ^ 3 - 1.120083 * 10 ^ (-6) * Temp ^ 4 +
6.536332
* 10 ^ (-9) * Temp ^ 5
A = 8.24501 * 10 ^ (-1) - 4.0639 * 10 ^ (-3) * Temp + 7.5719 * 10 ^ (-5) * Temp
^ 2 - 8.891 * 10 ^ (-7) * Temp ^ 3 + 6.616 * 10 ^ (-9) * Temp ^ 4
B = -5.7728 * 10 ^ (-3) + 9.7437 * 10 ^ (-5) * Temp - 1.3747 * 10 ^ (-6) * Temp ^
2
```

-continued

```
C = 4.9054 * 10 ^ (−4)
DensityTempSal = DensityTemp + A * Salinity + B * Salinity ^ (3 / 2) + C *
Salinity ^ 2
End Function
Private Function Kstp(Pressure, Temp, Salinity) As Double
Dim Kw, Aw, Bw, A, B, Kst As String
Kw = 19652.21 + 148.4206 * Temp − 2.327105 * Temp ^ 2 + 1.360477 * 10 ^ (−
2) * Temp ^ 3 − 5.155288 * 10 ^ (−5) * Temp ^ 4
Aw = 3.239908 + 1.43713 * 10 ^ (−3) * Temp + 1.16092 * 10 ^ (−4) * Temp ^ 2 −
5.77905 * 10 ^ (−7) * Temp ^ 3
Bw = 8.50935 * 10 ^ (−5) − 6.12293 * 10 ^ (−6) * Temp + 5.2787 * 10 ^ (−8) *
Temp ^ 2
B = Bw + (−9.9348 * 10 ^ (−7) + 2.0816 * 10 ^ (−8) * Temp + 9.1697 * 10 ^ (−10)
* Temp ^ 2) * Salinity
A = Aw + (2.2838 * 10 ^ (−3) − 1.0981 * 10 ^ (−5) * Temp − 1.6078 * 10 ^ (−6) *
Temp ^ 2) * Salinity + 1.91075 * 10 ^ (−4) * Salinity ^ (3 / 2)
Kst = Kw + (57.6746 − 0.603459 * Temp + 1.09987 * 10 ^ (−2) * Temp ^ 2 −
6.167 * 10 ^ (−5) * Temp ^ 3) * Salinity + (7.944 * 10 ^ (−2) + 1.6483 * 10 ^ (−2) * Temp −
5.3009 * 10 ^ (−4) * Temp ^ 2) * Salinity ^ (3 / 2)
Kstp = Kst + A * (Pressure * 0.01) + B * (Pressure * 0.01) ^ 2
End Function
Private Sub ClearButton_Click( )
    Range("H30:J1029").ClearContents
    Range("L30:M1029").ClearContents
End Sub
Private Sub SetupButton_Click( )
SetupForm.Show
End Sub
```

In some cases, more than one computing unit may contain a module or may be used to carry out the methods and systems disclosed here. All modules need not be on the same computing unit. Each module includes a memory, such as a portion of a computer readable medium, storing instructions, for example, scripted or compiled program code, for carrying out the function of the module. Instructions may be stored in bits. Each set of instructions may include logic patterns. Each computing unit has a central processing unit, associated circuitry and memory, and may be loaded on a circuit board. A power source may be provided, as may a power input connected to the computing unit. The computing unit may be a general purpose computer. The computing unit may be connected directly or indirectly to a display showing data for example using pixels arranged on a screen. A module may include other hardware, such as a computer, connections, and displays, required to operate the function of the module. Connections may be wired or wireless through a network such as the internet, LAN, or other suitable network. Storage of data could be done on a computer readable medium in the form of memory, RAM, hard drive space, flash drive space, or other suitable medium storage. Although many examples above disclose the existence of certain items or steps as absolutes, it should be understood that such items are not absolute in other examples. Calculations and TVD determination may be made on the fly as sensor readings arrive. The algorithm may comprise a stability detection module that takes a reading that has stabilized, based on achievement of a consistent reading within a predetermined period of time for example, or using more complex algorithms.

A sub may be a short piece of pipe that can be box ended, pin ended, or have changes in outside diameters. To measure annular pressure, a hole may be present in a sub so that a pressure sensor inside of the sub is exposed to the outside of the string 28.

Pressure at sensor 30 may be calibrated by subtracting surface pressure, which may be ambient surface pressure or pressure at surface within the tubing string 28. Alternatively, if delta TVD is calculated between two downhole positions, the pressure at sensor 30 may be calibrated by subtracting the pressure at the upper of the two downhole positions. Pressure sensors include transducers. Where an upper pressure sensor is used in fluid column 48, the upper pressure sensor may be submerged within the fluid column. The use of words such as up, down, upper, uphole, downhole, vertical and other relative words is intended to be relative and not restricted to meanings tied to absolute vertical as defined by the direction of gravitational acceleration while on the earth.

Salinity and other corrections may be unnecessary when calculations are based on an initial density measured at the surface of fluid in the fluid column 48, as the salinity is not expected to change when the fluid is downhole, due to the closed system of the fluid circuit. In some cases a densitometer, such as a hydrometer, may be used, for example to obtain an initial density, and in other cases densitometers may be used for example in association with sensors 30 and 56 at the downhole position 14. A series of densitometers may be used spaced along a wireline within the fluid column 48 in one case, to determine a density profile to be used in the determination of TVD. Scales or pressurized scales may also be used.

Each circulation may remove air or any other gases or any other impurities from the system. Components that are located at a certain point may be located at or near the point. A tubing string 28 may exclude casing and well bore, for example the tubing string 28 may be a tubing string that is suspended within the well 10 by a surface rig, as opposed to a tubing hanger. The tubing string 28 may include jointed, coiled, or coil in coil (concentric) tubing. The fluid circuit at surface may comprise a fluid return line to a central drum, to an open air surface tank, which may be a settling and cooling tank with several compartments or separate containment tanks, collectively considered reservoir 70 in the Figures. Fresh fluid from reservoir 70 may be pumped via a transfer pump to a suction tank, then a further pump into the coil tubing. The second chamber in the housing may comprise a bull nose to terminate the tubing string 28. Surveys may be taken in ten seconds or less. In some cases the difference between the temperature of return fluid and the temperature of supply fluid may be used to calculate the average temperature, and hence density, of the fluid column. In one case, continuous measurements of pressure and temperature are taken while sensors 30 and 56 are moved up or down the well 10. In one case, instead of or in addition to calculations using a formula, a multi-dimensional lookup reference table may be used for error corrections, for example with measured values for water density at different pressures, temperatures, and salinity. Various formulas may be used to determine TVD, including formulas equivalent to the ones discussed above but that use different coefficients.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of determining true vertical depth ("TVD"), within a well penetrating a ground surface, the method comprising:

positioning a tubing string downhole such that a pressure sensor, located within an interior of the tubing string, is located at a base downhole position within the well at a base of a fluid column extended from a ground surface to the pressure sensor within the tubing string;

measuring, with the pressure sensor, or a plurality of pressure sensors that include the pressure sensor, a plurality of pressures exerted by the fluid column, in which the pressure is measured by the pressure sensor, or the plurality of pressure sensors, while fluid in the fluid column is stationary;

measuring a temperature of fluid in the fluid column at each of a series of positions to generate a series of temperature measurements, each associated with a respective position, of the series of positions, along the fluid column, in which the series of temperature measurements are taken while fluid in the fluid column is stationary;

generating a density profile of fluid along the fluid column based on the series of temperature measurements; and determining the TVD of the base downhole position using the density profile of fluid along the fluid column to correct for density changes of fluid along the fluid column, and using the plurality of pressures measured by the pressure sensor or the plurality of pressure sensors.

2. The method of claim 1 in which the fluid column comprises a liquid.

3. The method of claim 2 in which the liquid comprises water.

4. The method of claim 1 in which positioning further comprises inserting the tubing string into the well.

5. The method of claim 4 in which the tubing string comprises coiled tubing.

6. The method of claim 4 further comprising, prior to measuring the pressure with the pressure sensor or the plurality of pressure sensors, replacing the volume of fluid in the fluid column with fresh fluid from a surface supply reservoir.

7. The method of claim 6 in which a fluid circuit is defined from the surface reservoir down the fluid column and back up a return passage to a surface return reservoir, and in which replacing further comprises circulating fresh fluid through an entire cycle of the fluid circuit.

8. The method of claim 7 in which the tubing string comprises concentric tubing positioned within the well, the concentric tubing having an inner tubing that defines an inner passage, and an outer tubing that collectively with the inner tubing defines an outer annulus within the tubing string, in which one of the inner passage and the outer annulus contains the fluid column, and the other one of the inner passage and the outer annulus contains the return passage.

9. The method of claim 8 in which the tubing string comprises a housing defining a chamber at the base of the fluid column, the housing having respective ports connected to the inner passage and return passage.

10. The method of claim 9 in which the pressure sensor is mounted within the chamber.

11. The method of claim 6 in which a fluid circuit is defined from the surface reservoir down the fluid column and back up a return passage, and one of the tubing string and a well bore annulus between the well and the tubing string contains the fluid column, and the other one of the tubing string and the well bore annulus contains the return passage.

12. The method of claim 11 in which:

the fluid column is contained within the tubing string;

a valve is connected to the tubing string between the fluid column and the return passage; and the pressure sensor is mounted in an uphole direction above the valve.

13. The method of claim 1 in which the pressure sensor is associated with a temperature sensor, and in which the temperature sensor is used to measure the temperature of fluid in the fluid column at the base downhole position.

14. The method of claim 13 in which the stages of measuring the plurality of pressures and measuring the plurality of temperatures, is carried out using the pressure sensor and the temperature sensor, respectively, by repeating the stages of positioning, measuring a pressure, and measuring a temperature, at the series of positions.

15. The method of claim 1 in which determining is carried out using a computing unit.

16. The method of claim 1 in which fluid in the fluid column comprises drilling mud, the pressure sensor is mounted to a drill string, and the method is carried out as part of a drilling operation.

17. The method of claim 13 in which:

the series of positions at which temperature is measured in the fluid column include a series of downhole positions below the ground surface; and the plurality of pressure sensors are spaced along the tubing string at the series of downhole positions; and in which determining the true vertical depth TVD of the base downhole position further comprises using the pressures measured by the plurality of pressure sensors.

18. The method of claim 1 further comprising determining a second true vertical depth TVD using a position sensor within the well.

19. The method of claim 1 in which determining the TVD of the base downhole position is carried out using salinity of fluid in the fluid column to correct for density changes of fluid along the fluid column.

20. The method of claim 1 in which the series of positions at which temperature is measured in the fluid column include a series of downhole positions below the ground surface.

* * * * *